US007616906B2

(12) United States Patent
Yamamoto

(10) Patent No.: US 7,616,906 B2
(45) Date of Patent: Nov. 10, 2009

(54) IMAGE FORMING DEVICE, IMAGE FORMING METHOD, AND A COMPUTER READABLE STORAGE MEDIUM STORED WITH IMAGE FORMING PROGRAM

(75) Inventor: Kazuto Yamamoto, Tokyo (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 333 days.

(21) Appl. No.: 11/497,359

(22) Filed: Aug. 2, 2006

(65) Prior Publication Data

US 2007/0242962 A1 Oct. 18, 2007

(30) Foreign Application Priority Data

Apr. 14, 2006 (JP) ..... 2006-112583

(51) Int. Cl.
*G03G 15/00* (2006.01)

(52) U.S. Cl. ..... 399/15; 399/82

(58) Field of Classification Search ..... 399/15, 399/82, 405

See application file for complete search history.

(56) References Cited

U.S. PATENT DOCUMENTS 5,164,842 A * 11/1992 Gauronski et al.
6,341,907 B1 * 1/2002 Katsuyoshi ..... 399/82
7,245,845 B2 * 7/2007 Isobe et al. ..... 399/407
2003/0044193 A1 * 3/2003 Thomas et al.

FOREIGN PATENT DOCUMENTS

| | | |
|---|---|---|
| JP | 04-158076 | 6/1992 |
| JP | 04-346370 | 12/1992 |
| JP | 08-106191 | 4/1996 |
| JP | 10-081048 | 3/1998 |
| JP | 10-291356 | 11/1998 |
| JP | 2003-094756 | 4/2003 |
| JP | 2005-094524 | 4/2005 |
| JP | 2005-153374 | 6/2005 |

OTHER PUBLICATIONS

Decision of Refusal in JP 2006-112583 dated Aug. 5, 2008, and Translation thereof.
Notification of Reason for Refusal in JP 2006-112583 dated Apr. 8, 2008, and Translation thereof.

* cited by examiner

*Primary Examiner*—Susan S Lee
(74) *Attorney, Agent, or Firm*—Buchanan Ingersoll & Rooney PC

(57) ABSTRACT

An image forming method for controlling a device to receive a printing job; and to execute an intervening of a proof-printing to print at least one certain page of the received printing job in order to check its quality while an another printing job is being processed if the proof-printing is specified to the received printing job and if another printing job is being processed.

7 Claims, 10 Drawing Sheets

IMAGE FORMING DEVICE, IMAGE FORMING METHOD, AND A COMPUTER READABLE STORAGE MEDIUM STORED WITH IMAGE FORMING PROGRAM

CROSS-REFERENCE TO RELATED APPLICATION

This application is based on Japanese Patent Application No. 2006-112583 filed on Apr. 14, 2006, the contents of which are incorporated herein by reference.

BACKGROUND OF THE INVENTION

1. Field of the Invention

The invention relates to an image forming device, an image forming method, and a computer readable storage medium stored with image forming program. The invention relates particularly to an image forming device, an image forming method, and a computer readable storage medium stored with image forming program for proof-printing, i.e., printing a certain page of a printing job for a confirmation purpose.

2. Description of the Related Art

An image forming device that is used for light printing jobs typically is equipped with a stacker of a large capacity for keeping printed sheets in stacks. The stacked paper is taken out by opening a door of the stacker and the stacker is used with the door closed during printing.

Therefore, since the door is closed while the paper discharged from the image forming unit is stacked in the stacker, it is difficult to visually check the quality of the images formed on the paper from the outside.

In order to solve this problem, an image forming device is proposed in which the discharge destination of printed paper is switched from a primary stacking unit that prevents visual checks of images printed on paper to a secondary stacking unit that allows visual checks of images printed on paper when a certain condition is satisfied, e.g., a certain number of pages is printed, and later switching again to the primary stacking unit. See Unexamined Publication No. JP-A-2005-153374.

However, the image forming device disclosed in said patent document has a problem that, if an image forming device that is to be used is currently involved in printing a previous job, it is impossible to check the image quality of the next printing job or anything thereafter by actually printing certain pages thereof until after the printing of the current job is completed.

OBJECTS AND SUMMARY

An object of an embodiment of the invention is to provide an image forming device, an image forming method, and a recording medium storing an image forming program with a capability of allowing the operator to check the images of printing jobs that follow a preceding job currently being printed by actually printing certain pages of said following jobs.

An image forming device comprises a receiving unit that receives a printing job; and a control unit that performs control for executing an intervening of a proof-printing to print at least one certain page of the received printing job in order to check its quality while an another printing job is being processed if the proof-printing is specified to the received printing job and if another printing job is being processed.

An image forming method comprises receiving a printing job; and executing an intervening of a proof-printing to print at least one certain page of the received printing job in order to check its quality while an another printing job is being processed if the proof-printing is specified to the received printing job and if another printing job is being processed.

The objects, features, and characteristics other than those set forth above will become apparent from the description given herein below with reference to preferred embodiments illustrated in the accompanying drawings.

DETAILED DESCRIPTION OF PREFERED EMBODIMENTS

The embodiments of this invention will be described below with reference to the accompanying drawings.

Figure 1:
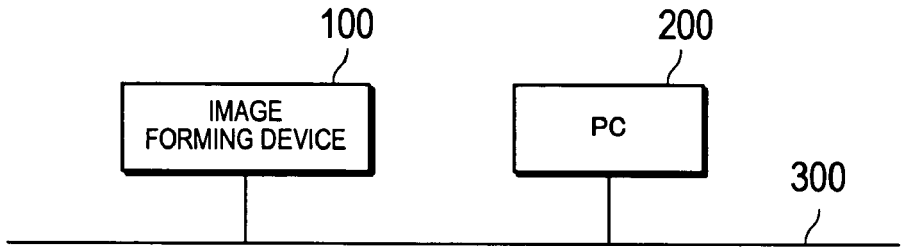
FIG. 1 is a block diagram showing the entire constitution of an image processing system including an image forming device according to an embodiment of the present invention.

FIG. 1 is a block diagram showing the entire constitution of an image processing system including an image forming device according to an embodiment of the present invention. The image processing system is equipped with an image forming device 100 and a PC (personal computer) 200 that functions as a printing instructing device, all of which are connected via a network 300 to be able to communicate with each other. The types and the number of equipment to be connected to the network 300 are not limited to those shown in FIG. 1. Also, the image forming device 100 and the PC 200 can be connected directly (local connection) without recourse to the network 300.

Figure 2:
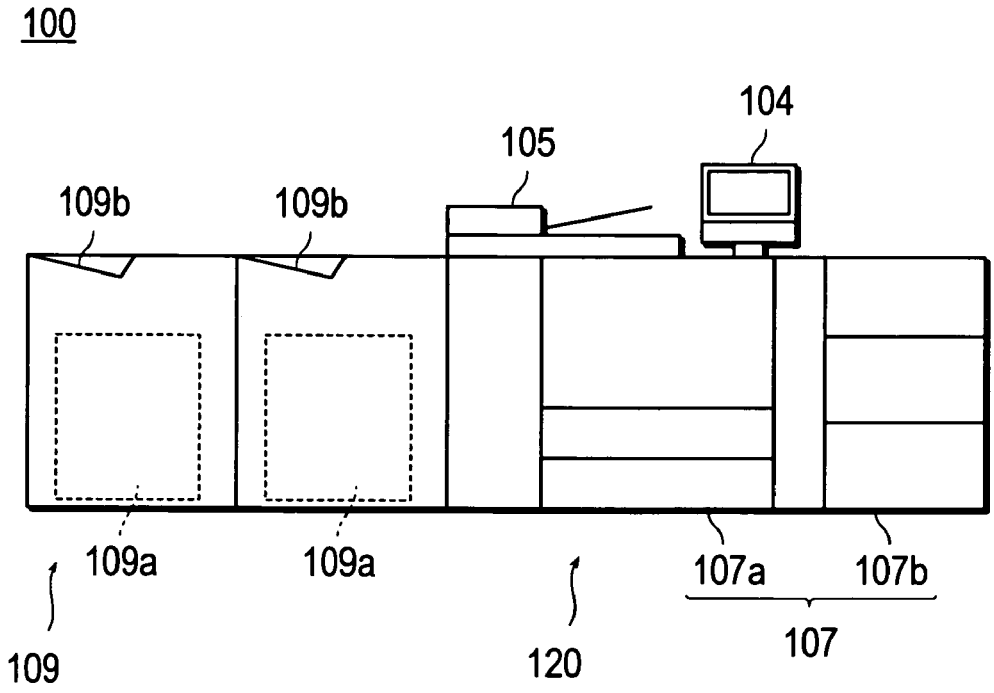
FIG. 2 is a schematic front view showing an external view of the image forming device shown in FIG. 1.
Figure 3:
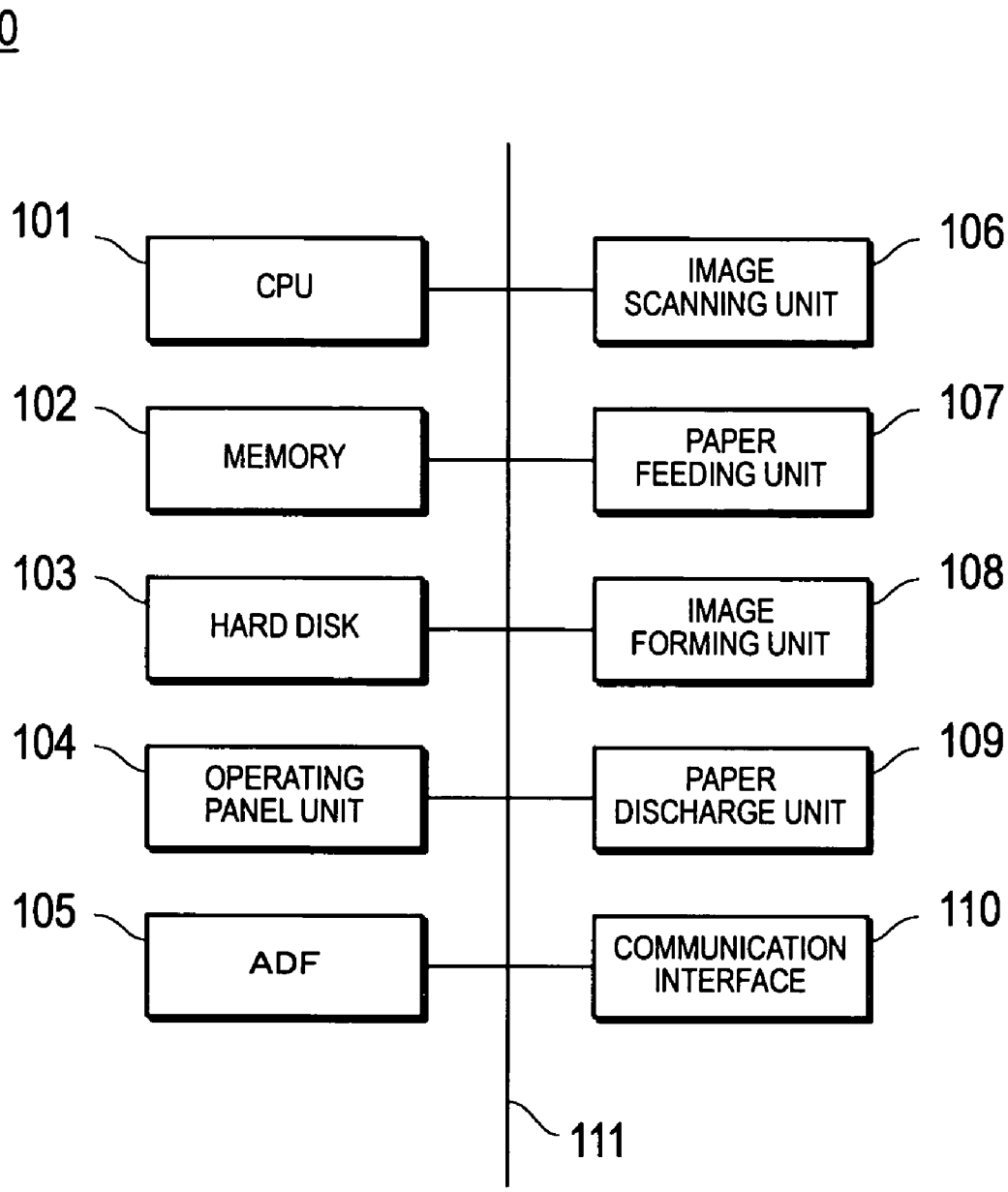
FIG. 3 is a block diagram showing the constitution of the image forming device shown in FIG. 1.

FIG. 2 is a schematic front view showing an external view of the image forming device shown in FIG. 1, and FIG. 3 is a block diagram showing the constitution of the image forming device shown in FIG. 1.

The image forming device 100 includes a CPU 101, a memory 102, a hard disk 103, an operating panel unit 104, an ADF (Auto Document Feeder) 105, an image scanning unit 106, a paper feeding unit 107, an image forming unit 108, a paper discharge unit 109, and a communication interface 110, all of which are interconnected via a bus 111 for exchanging signals. The CPU 101, memory 102, hard disk 103, image scanning unit 106, image forming unit 108, and communication interface 110 are all built into a main unit 120 (see FIG. 2) of the image forming device 100.

The CPU 101 controls various parts indicated above and executes various arithmetic processes according to a program. The memory 102 stores programs and data temporarily as a working area. The hard disk 103 stores various programs including an operating system and data.

The operating panel unit 104 is equipped with a touch panel, a ten-key pad, a start button, a stop button, a reset button and others to be used for displaying various data and entering various instructions.

The ADF 105 transports a single or multiple sheets of paper one sheet at a time to a specified scanning position of the image scanning unit 106, and discharges the document sequentially after scanning it.

The image scanning unit 106 irradiates a document set on the specified scanning position or transported to the specified scanning location by the ADF 105 with a light source such as a fluorescent lamp and the like, converts reflected lights from the document surface into electrical signals with the help of light sensitive devices such as a CCD image sensor, and generates image data from the electrical signals.

The paper feeding unit 107 stores paper used as a recording medium in printing. The paper feeding unit 107 consists of a first paper feeding unit 107*a* provided in the main unit 120 and a second paper feeding unit 107*b* capable of storing a large amount of paper. The paper feeding unit 107 feeds the stored paper one sheet at a time to the image forming unit 108.

The image forming unit 108 prints various data on paper using a known imaging process such as the electronic photographic process, which consists of electrical charging, exposure, developing, transferring and fixing processes.

The paper discharge unit 109 receives printed paper, which is transferred from the image forming unit 108 and discharged from the main unit 120. In the present embodiment, the paper discharge unit 109 is equipped with primary stacking units 109*a* capable of stacking a large amount of printed paper and secondary stacking units 109*b* for stacking a relatively small amount of printed paper. Each of the primary stacking units 109*a* has an elevator capability in which a stacking surface moves up and down depending on the amount of paper stacked on it up to, for example, 5000 sheets. Alternatively, the paper discharge unit 109 may have only one primary stacking unit 109*a* and one secondary stacking unit 109*b*.

The communication interface 110 is typically a LAN card and is used for communicating with external equipment via a network 300.

Figure 4:
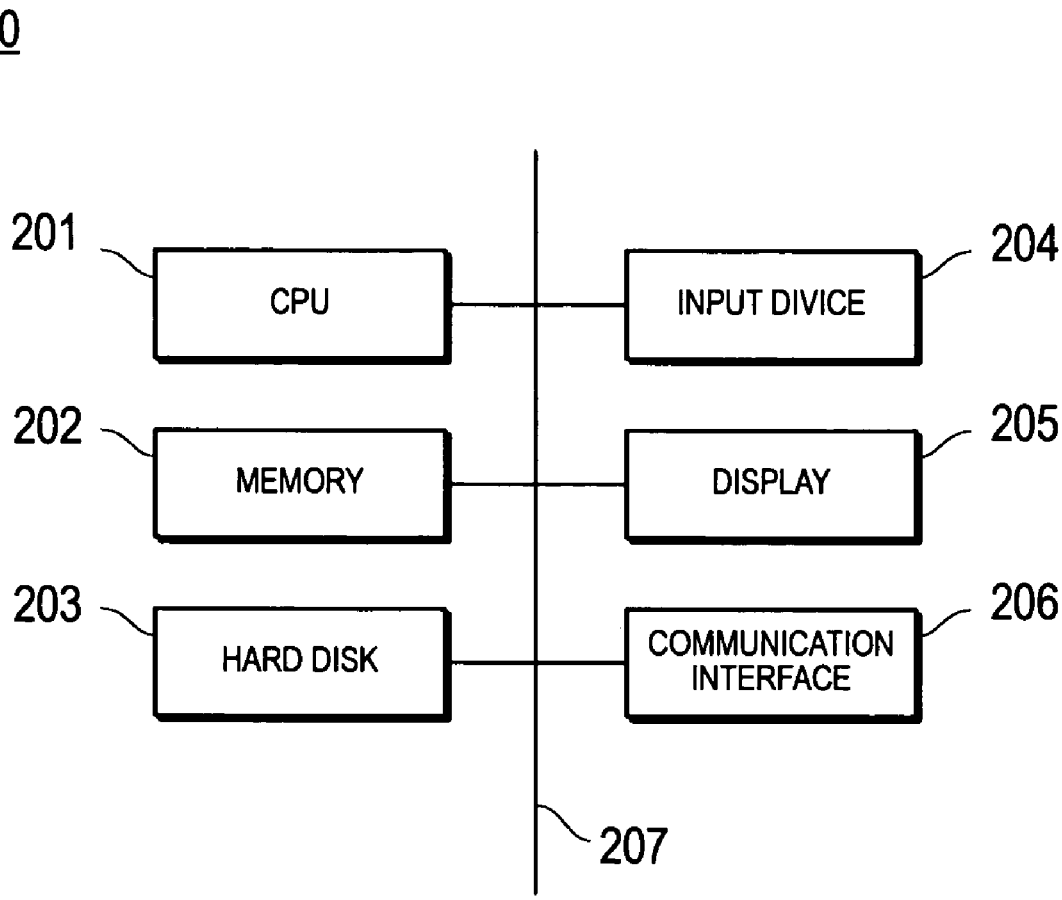
FIG. 4 is a block diagram showing the constitution of the PC shown in FIG. 1.

FIG. 4 is a block diagram showing the constitution of the PC shown in FIG. 1.

The PC 200 contains a CPU 201, a memory 202, a hard disk 203, an input device 204, a display 205, and a communication interface 206, all of which are interconnected via a bus 207 for exchanging signals. The descriptions of those parts of the PC 200 that have the same functions as those of the corresponding parts of the image forming device 100 are omitted here to avoid unnecessary duplication.

The hard disk 203 has an application program for generating document files and a printer driver for converting the document files into printing jobs (print data) described in a language understood by the image forming device 100 installed.

The input device 204 includes a pointing device such as a mouse, a keyboard, and others, and is used for executing various kinds of inputs. Display 205 is typically a liquid crystal display and displays various kinds of information.

The image forming device 100 and the PC 200 can each contain constitutional elements other than those described above, or may lack a portion of the abovementioned elements.

The network 300 can be a LAN connecting computers and network equipment according to standards such as Ethernet®, Token Ring, and FDDI, or a WAN that consists of several LANs connected by a dedicated line.

The operation of the image forming device 100 in this embodiment will be described in the following.

FIG. 5 through FIG. 9 represent a flowchart showing the image forming process of the image forming device 100 according to this embodiment. The algorithm shown in the flowcharts of FIG. 5 through FIG. 9 is stored as a program in a memory unit such as the hard disk 103 of the image forming device 100, read by the CPU 101, and executed on the memory 102.

Figure 5:
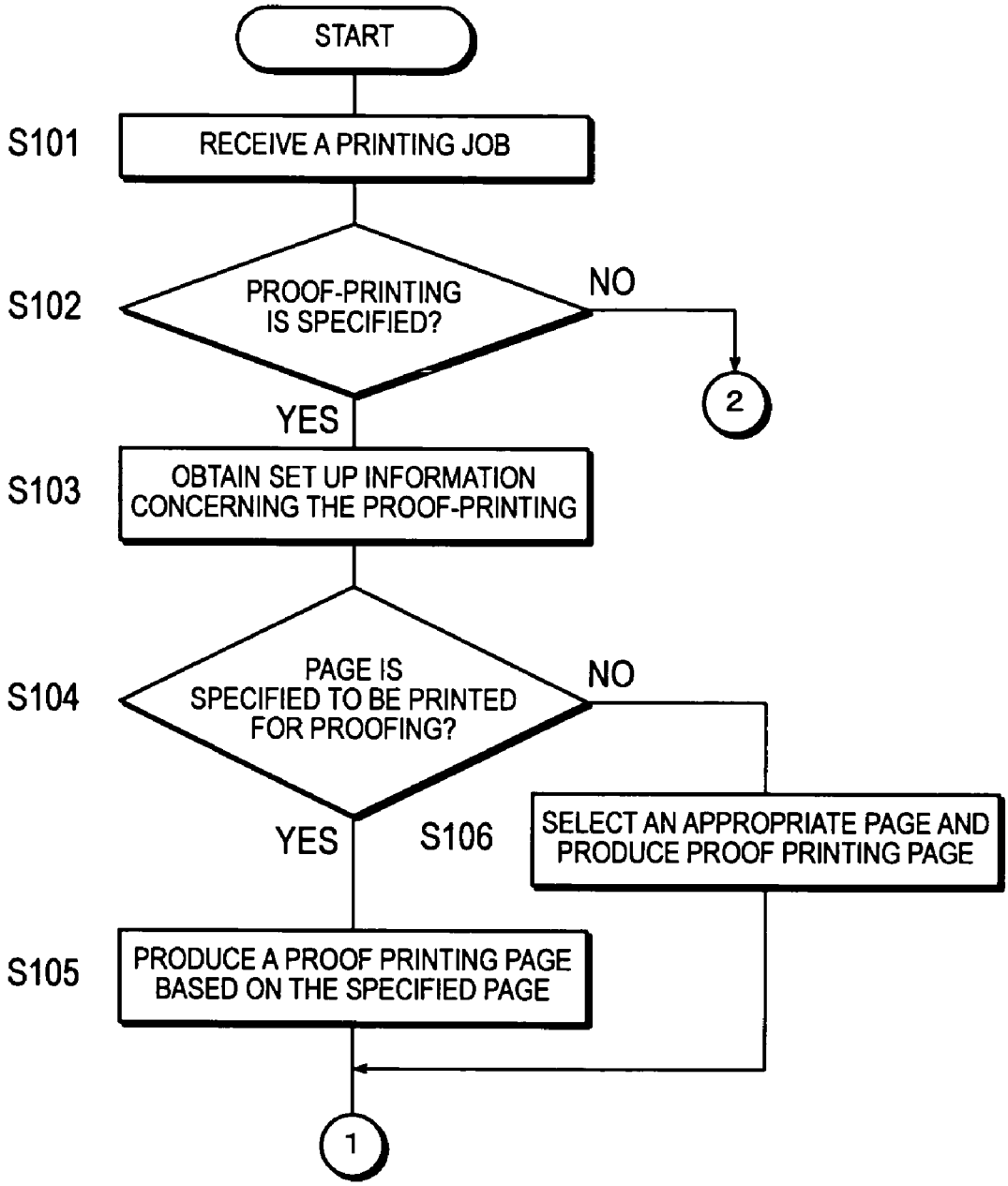
FIG. 5 is a flowchart showing the procedure of the image forming device according to this embodiment.

With reference to FIG. 5, the image forming device 100 receives a printing job, for example, from the PC 200 via the communication interface 110 (S101). However, the printing job can be entered by the user by instructions through the operating panel unit 104.

Next, a judgment is made as to whether proof-printing is specified for printing a certain page of said printing job in order to check the printing result (S102). In other words, when a printing job is entered into a printing queue, it is checked if there is any proof-printing instruction attached to the entered printing job.

If it is found that no proof-printing is specified to the received printing job (S102: No), the particular printing job is left as is in the printing queue to wait its turn of execution. In other words, the particular printing job is executed immediately if there is no printing job ahead of it or executed all other jobs are completed if there are other printing jobs ahead of it.

If proof-printing is specified for the received printing job (S102: Yes), the setup information concerning the proof-printing contained in the printing job is obtained (S103). The setup information concerning the proof-printing can be, for example, the page to be printed and the destination of the printed material to be discharged.

Figure 10:
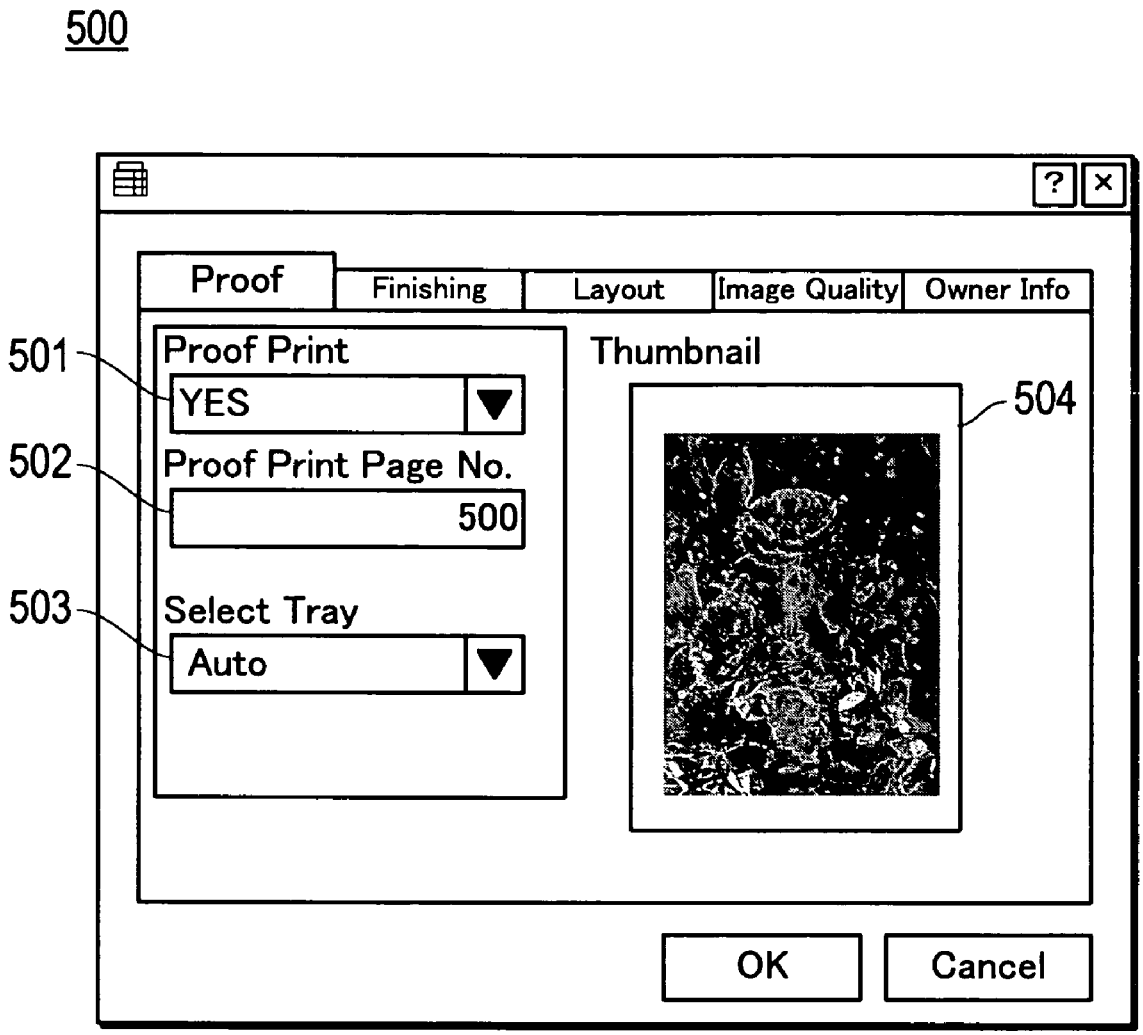
FIG. 10 is a diagram showing an example setup screen.

FIG. 10 shows an example of a setup screen 500 to be displayed by the printer driver in the PC 200 on the display 205. The setup screen 500 includes a proof-printing specifying region 501 for specifying proof-printing, a page specifying region 502 for specifying the page(s) to be printed for proofing, a tray specifying region 503 for specifying the destination of the printed material to be discharged, and a thumbnail display region 504 for displaying thumbnail image of the page specified for the proof-printing. In case of FIG. 10, the proof-printing is specified (specified to Yes), the 500-th page is specified to be printed for proofing, and the discharge destination is specified as "Auto" by the user's manual operation. The page to be printed for proofing is indicated by thumbnail images. The setup information concerning the proof-printing specified by the user's manual operation on the setup screen 500 is transmitted to the image forming device 100 from the PC 200 as a part of the printing job.

Next, a judgment is made as to whether a page is specified to be printed for proofing (S104). If a page is specified to be printed for proofing (S104: Yes), the page specified as a result of the user's manual operation is selected as the target of the proof-printing and the proof-printing page is printed (S105). Since the page to be proof-printed can thus be specified based on the user's selection, the user can specifically check the printing output result of a page where high quality result is required.

On the other hand, if the page to be printed for proofing is not specified (S104: No), the page more appropriate for proof-printing, for example, a page with less text and more graphics, is automatically selected as the target of the proof-printing to produce a page to be printed for proofing (S106).

In such a case, the image forming device 100 adds to the page to be printed for proofing certain information concerning the printing job that corresponds to the particular page. The information to be added concerning the printing job includes its job number, file name, user's name, etc. By constituting in such a way, printed materials can be clearly identifiable even if the proof-printing is executed for a plurality of users or a plurality of jobs.

Next, the numerical value "1" and "0" are set for the proof flag and the completion flag, respectively (S107). If the proof flag is "1," it means that a need for proof-printing to be executed exists. Also, if the completion flag is "0," the loop to be described later will be repeated.

The loop (step S108-S113) will be initiated in the step S108. The particular loop is repeated thereafter until the completion flag becomes "1."

In the step S109, a judgment is made as to whether there is any other printing job that is being output (printed) at the moment. If there is a job being output (printed) at the moment (S109: Yes), the first proof-printing process is executed (S111) while continuing to execute the other printing job being output (S110).

Figure 7:
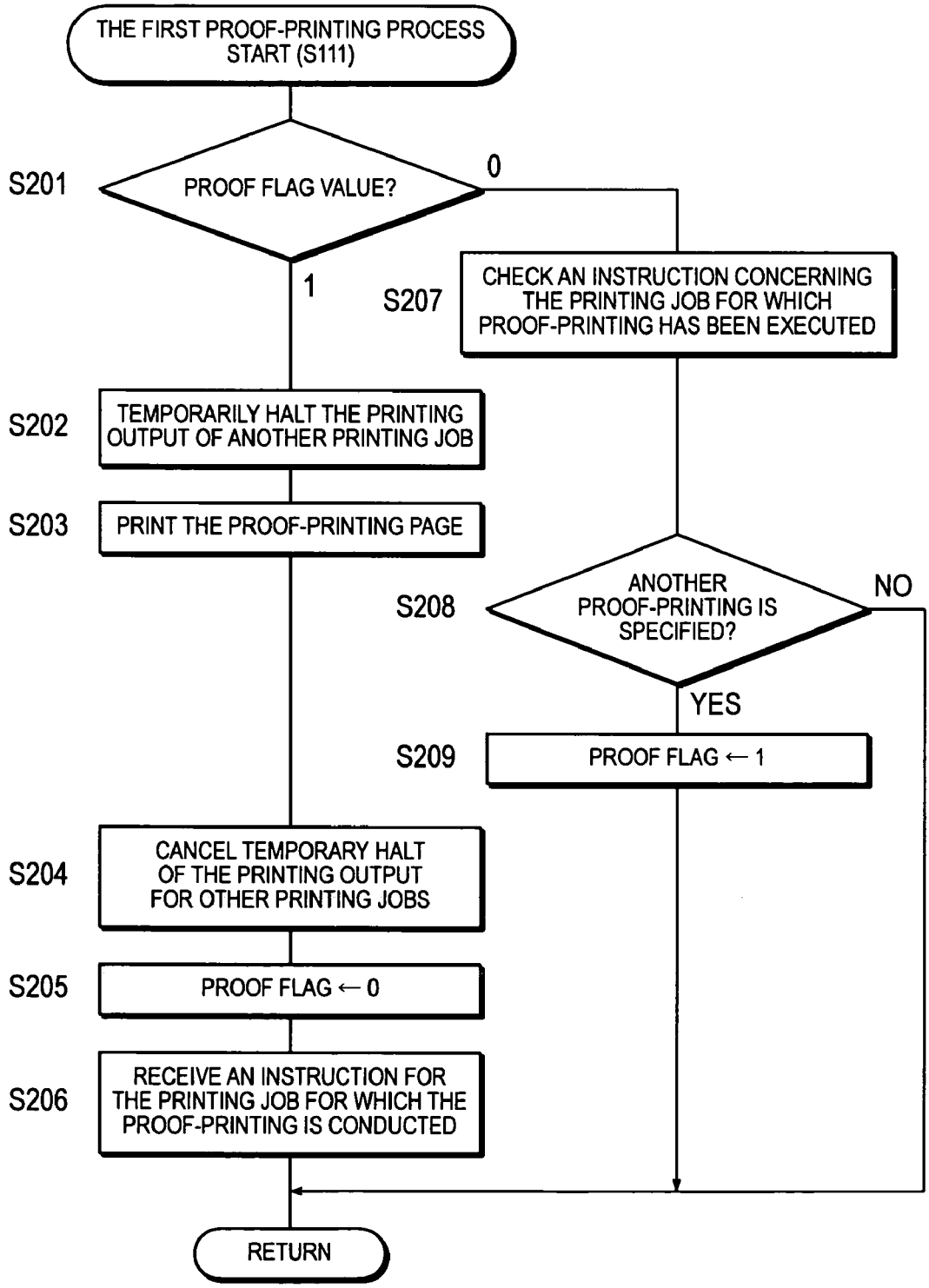
FIG. 7 is a flowchart showing the procedure of a first proof-printing process.

Next, let us describe the first proof-printing process (S111) with reference to FIG. 7.

First, the value of the proof flag is checked (S201). If the proof flag is "1" (S201: "1"), the proof-printing process is initiated. In other words, the image forming device 100 first temporarily halts the printing output of another printing job (S202).

Next, the proof-printing page prepared in the step S105 or S106 is printed on the paper (S203). Here, the printed page for proof-printing is discharged to a discharge destination different from the discharge destination specified for the other printing job temporally held up. For example, if the printed pages contained in the other printing job are being discharged to the primary stacking unit 109*a*, the printed page for proof-printing is discharged to the secondary stacking unit 109*b*. By constituting the system in such a manner, the user can easily and speedily obtain the printed page for proof-printing.

When the printing of the proof-printing page is completed, the temporary halt of the printing output for other printing jobs will be cancelled (S204), and the proof flag is set to "0" (S205).

Next, the instruction for the printing job for which the proof-printing is conducted in the step S203 is received (S206), and the system returns to the original flow chart. Such an instruction concerning a printing job is executed through the reception screen shown in the operating panel unit 104.

Figure 11:
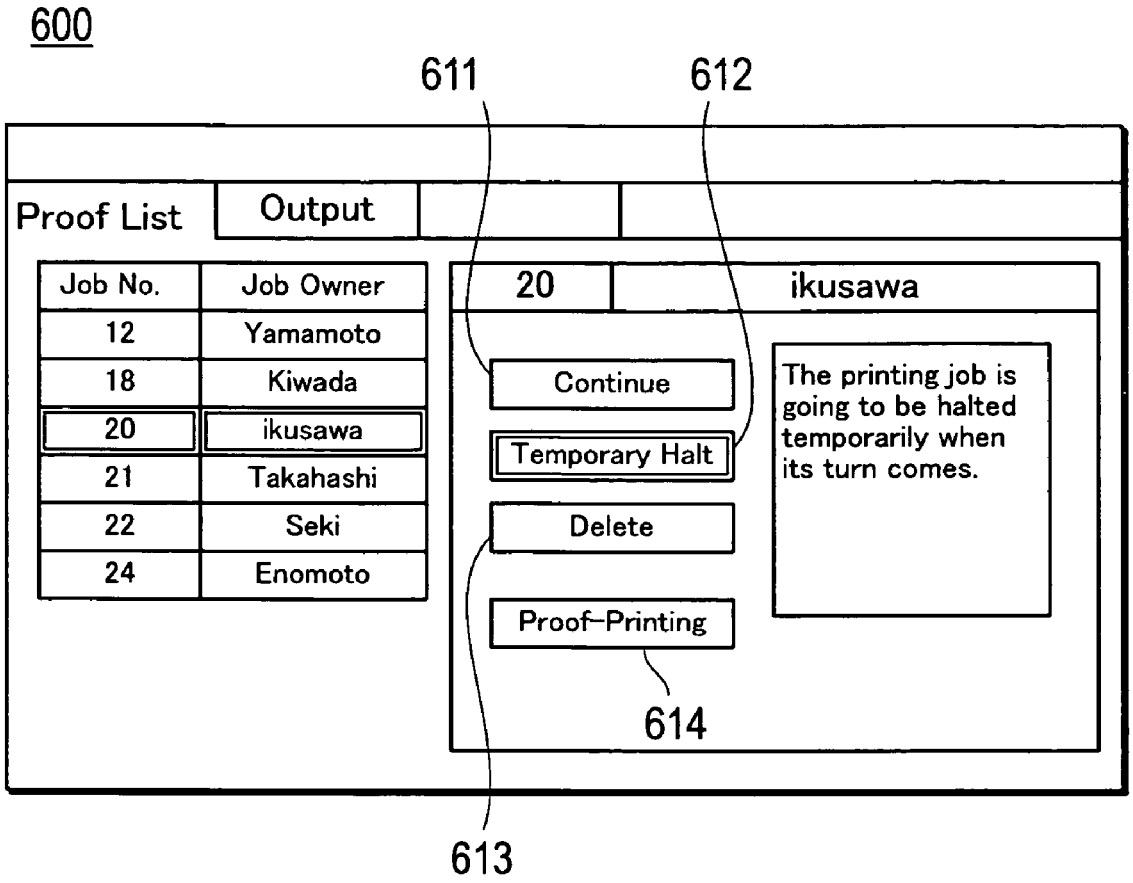
FIG. 11 is a diagram showing an example of a screen for receiving instructions concerning the printing job for which proof-printing is performed.

FIG. 11 is an example of an instruction-receiving screen 600 for receiving instructions concerning the printing job for which proof-printing is performed. The receiving screen 600 contains instruction buttons 611-614 for continuation of the particular printing job, temporary halting the particular printing job at the starting time, deleting the particular printing job, and proof-printing it again respectively. FIG. 11 shows a status in which proof-printing has been executed for a printing job whose job number is "20" and the instruction button for "temporary halt" has been selected by the user as a result.

On the other hand, if the proof flag is "0" in the step S201 (S201: "0"), a check is made to see if anyone has made an instruction concerning the printing job for which proof-printing has been executed (S207).

Then, a judgment is made as to whether another proof-printing is specified through the receiving screen 600 (S208). If another proof-printing is specified (S208: Yes), "1" is set to the proof flag (S209). If another proof-printing is not specified (S208: No), the operation returns to the original flowchart.

The procedure of the abovementioned steps S109 through S113 will be repeated until all other printing jobs currently in process are exhausted even if the image forming device 100 is conducting a large amount of printing based on other printing jobs. Therefore, the user can provide an instruction to execute calibration prior to the start of printing his/her job, for which proof-printing has been executed, after visually checking the printed page for proofing. The user can also conduct proof-printing again after having conducted image adjustments such as Y-compensation, image positioning, etc., by operating the operating panel unit 104. Moreover, since images can deteriorate as a result of continuous outputting (printing) in case of a large volume of printing, the user can repetitively conduct visual checks of the printed page for proofing by specifying repetitive proof-printing through the operating panel unit 104.

Proof-printing can be specified to be conducted periodically with a fixed interval. For example, the interval of periodic proof-printing executions can be set up on the setup screen displayed by the printer driver of the PC 200 in the advance. By constitution in such a manner, it is possible for the user to save the chore of specifying the proof-printing each time as it will be executed automatically at each page while printing other jobs.

Figure 6:
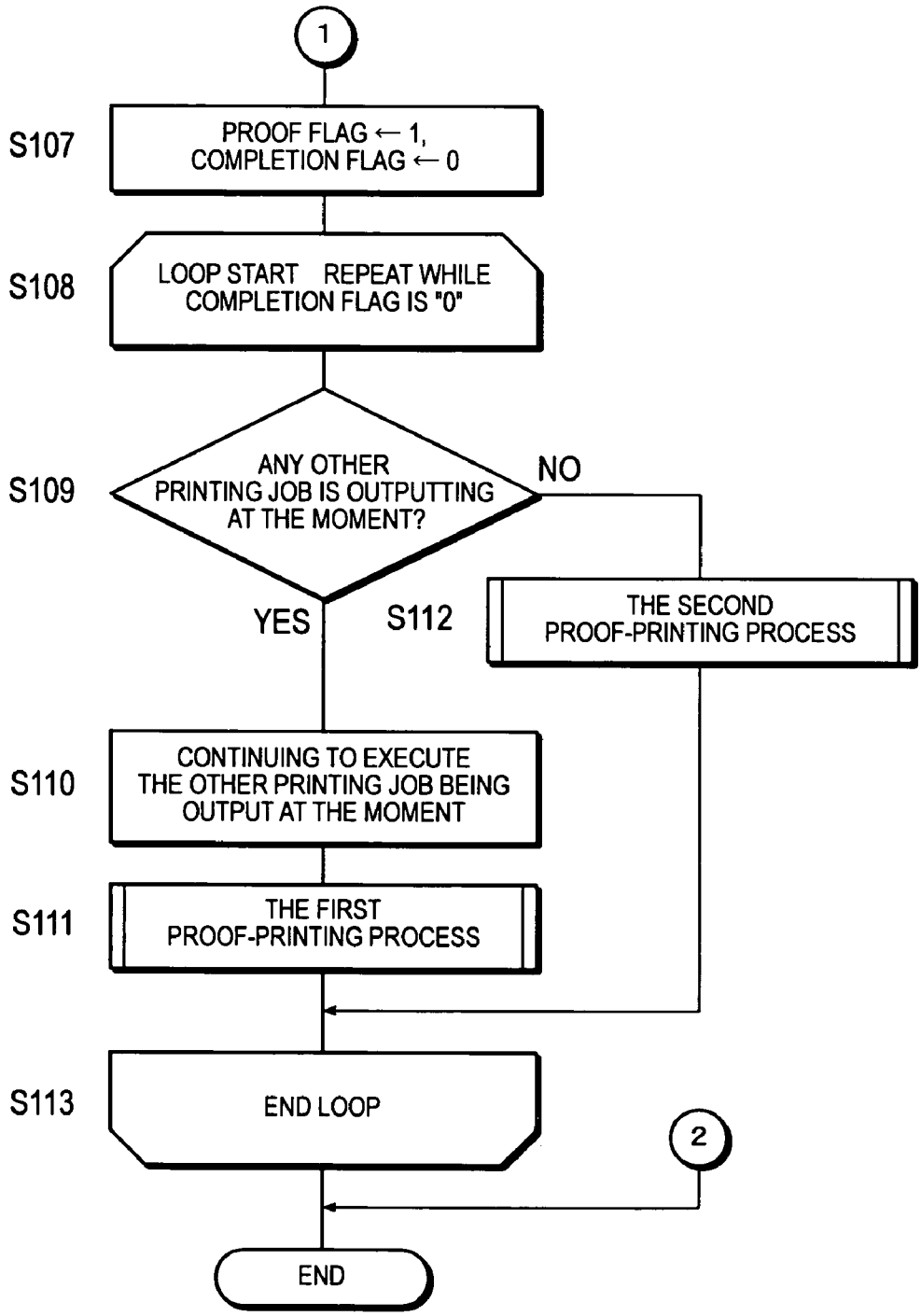
FIG. 6 is a flow chart showing the procedure on the image forming device according to this embodiment continued from FIG. 5.

Now getting back to the flowchart of FIG. 6, when the other printing job being printed is finished in the step S109 and it is the time for the printing job for which proof-printing is specified (S109: Yes), the second proof-printing process is executed (S112).

Figure 8:
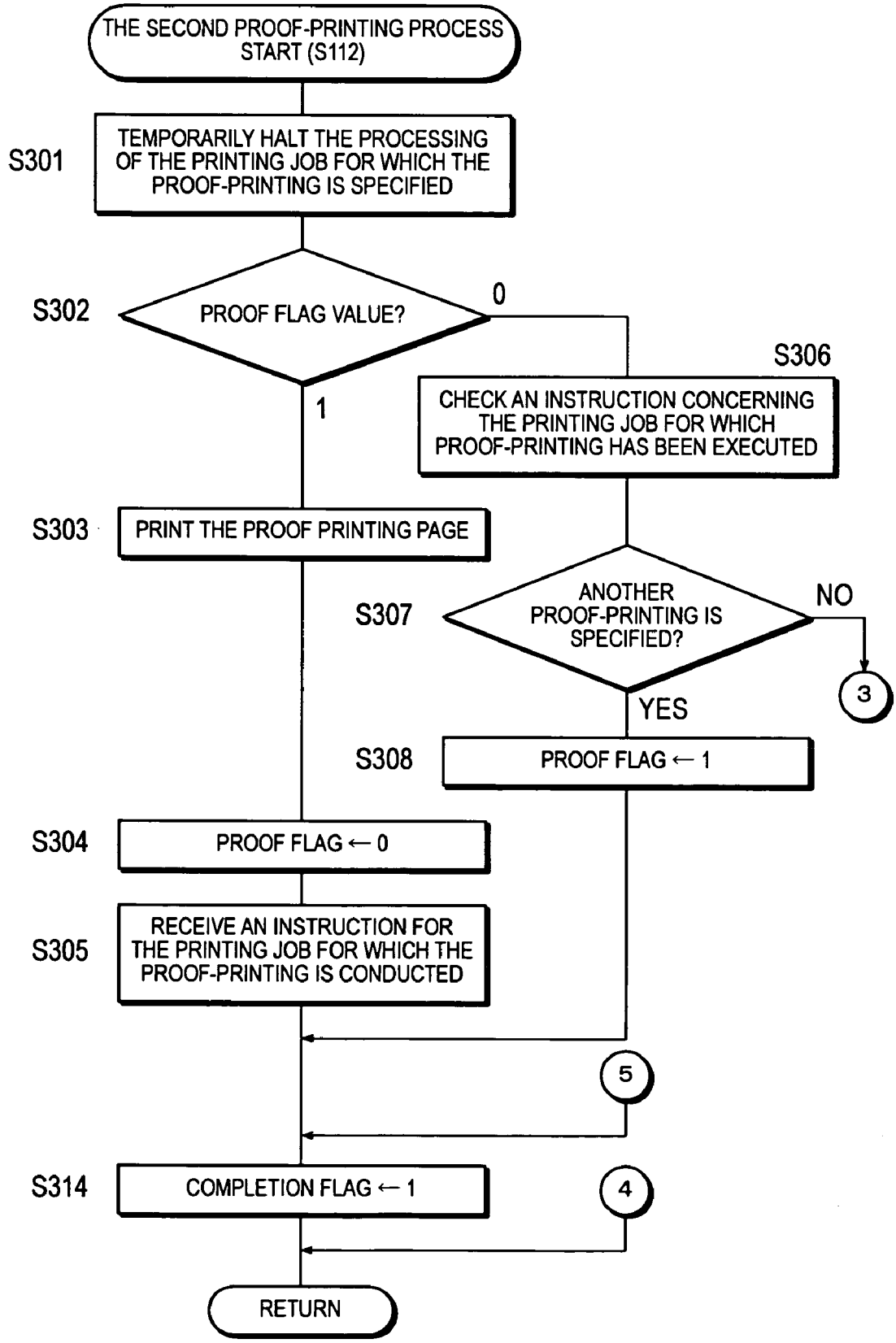
FIG. 8 is a flowchart showing the procedure of a second proof-printing process.
Figure 9:
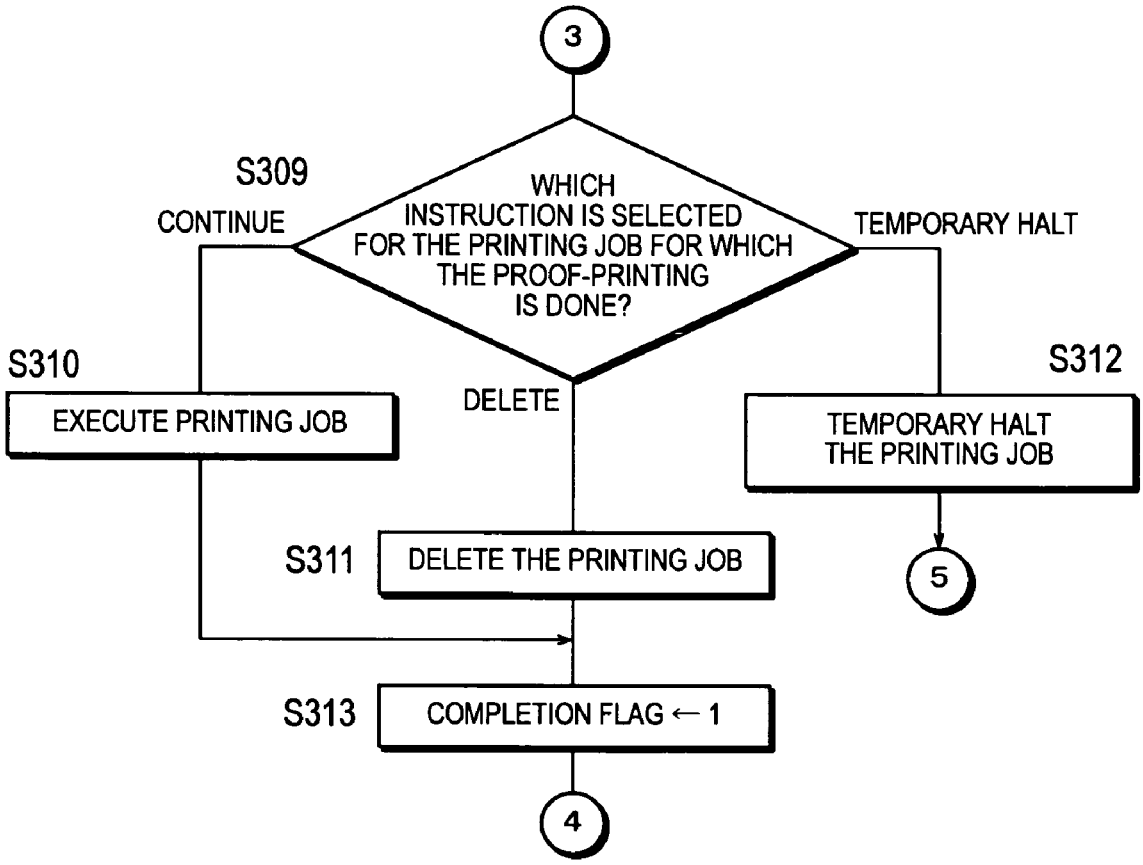
FIG. 9 is a flow chart showing the procedure of the second proof-printing process continued from FIG. 8.

Next, let us describe the second proof-printing process with reference to FIG. 8 and FIG. 9.

First, the image forming device 100 temporarily halts the processing of the printing job for which the proof-printing is specified (S301).

Next, the value of the proof flag is checked (S302). If the value of the proof flag is "1" (S302: "1"), the page for proof-printing is printed on paper (S303), and "0" will be set on the proof flag (S304).

Next, the instruction for the printing job for which the proof-printing is conducted in the step S303 is received (S305). Such a reception of the instruction concerning a printing job is executed through the reception screen 600 shown in the operating panel unit 104.

In the step S314, "0" is set on the completion flag, and the operation returns to the original flowchart of FIG. 6 after step S112.

On the other hand, if the proof flag is "0" in the step S302 (S302: "0"), a check is made to see if anyone has made an instruction concerning the printing job for which proof-printing has been executed (S306).

Then, a judgment is made as to whether another proof-printing is requested through the receiving screen 600 (S307). If another proof-printing is requested (S307: Yes), "1" is set to the proof flag (S308), and the operation continues on to the step S314.

If no other proof-printing is requested (S307: No), a check is made as to which instruction button is selected for the printing job for which the proof-printing is done (S309).

If it is judged in the step S309 that "Continue" instruction button is selected (S309: "Continue"), printing is executed based on the printing job for which the proof-printing is executed (S310), and the operation advances to the step S313. If it is judged in the step S309 that "Delete" instruction button is selected (S309: "Delete"), the printing job for which the proof-printing is executed will be deleted (S311), and the operation advances to the step S313.

In the step S313, "1" is set on the completion flag, and the operation returns to the original flowchart in FIG. 6 after step S112.

If it is judged in the step S309 that "Temporary Halt" instruction button is selected (S309: "Temporary Halt"), the process of the printing job for which the proof-printing is executed will be temporarily halt (S312), and the operation advances to the step S314.

If the desired image quality is not obtained in the printed page for proof-printing, for example, cleaning of the fixing unit is required, or replacement of consumable items, the user can select the "Temporary Halt" instruction button 612 on the receiving screen 600 displayed on the operating panel unit 104. In this case, the printing job for which the proof-printing is executed will be held up temporarily when its turn for execution comes. The user can take an appropriate measure to improve the image quality such as cleaning and replacement of consumable items during such a temporarily hold. Moreover, the user can select the "Proof-printing" instruction button 614 again. If a desired image quality is achieved as a result of visually confirming the printed page for proofing, the user can execute the printed output of the printing job for which the proof-printing is conducted by selecting the "Continue" instruction button 611.

Now getting back to the flowchart of FIG. 6, if the completion flag value is "1" in the step S113, the process of FIG. 5 through FIG. 9 will be completed through the loop (steps S109-S113). On the other hand, if the completion flag value is "0," the loop will be repeated.

On the other hand, if the printing job to which proof-printing is specified is temporarily halted, there is a possibility that the printed output of the printing job received by the image forming device 100 prior to the printing job to which the proof-printing is specified has been started in advance. Therefore, even if it is judged that other printing job that is currently being printed is temporarily exhausted, a check is repeated whether there is any other printing job each time when the loop is repeated (see S109).

As can be seen in the above, the image forming device 100 of the present embodiment controls the system to execute proof-printing while executing another printing job if there is another printing job being executed, if proof-printing is specified for the received printing job.

Therefore, according to the image forming device 100 of the present embodiment, it is possible to check image quality the later printing job even when the former printing job is being printed by actually printing a certain page of the latter job.

In other word, the user can check the quality of his/her printing job without delay. This makes it possible for the user to take necessary measures speedily when a desired image quality is not achieved on the proof-printing page. Moreover, the user can shorten the time required for a series of work from preparatory image quality check to actual printing of a job when a desired image quality is obtained as it is possible to start printing based on the job for which proof-printing is performed as soon as the printing of another printing job is completed.

The invention is not limited to the embodiment described above, but also can be changed in various ways within the scope of the claims.

For example, various image forming devices such as a printer, copying machine and MFP (Multi-Function Peripheral) can be used as the image forming device of the above-mentioned embodiment.

Though, a single page is printed for the proof-printing in the above embodiment, a plurality of pages may be specified and printed for the proof-printing. In this case, the user selects a plurality of pages as the target of the proof-printing.

The means and method of conducting various processes in the image forming device according to the present invention can be realized by a dedicated hardware circuit, or a programmed computer. Said program can be provided either by a computer readable recording medium such as a flexible disk and a CD-ROM, or by being supplied on-line via a network such as the Internet. In this case, the program recorded on the computer readable recording medium is normally transferred to and stored in a memory unit such as a hard disk. Said program can also be provided as independent application software or can be built into the software of the image processing device as a part of its function.

What is claimed is:

1. An image forming device comprising:

a receiving unit which receives a printing job; and a control unit that performs control for intervening of a proof-printing to print at least one certain page of the received printing job in order to check its quality while an another printing job is being processed if the proof-printing is specified to the received printing job and if another printing job is being processed;

wherein the printed page for proofing contains information concerning the printing job including said page.

2. The image forming device as claimed in claim 1, wherein the page to be printed for proofing is specified by a user's selection.

3. An image forming device, comprising:

a receiving unit which receives a printing job; and a control unit that performs control for intervening of a proof-printing to print at least one certain page of the received printing job in order to check its quality while an another printing job is being processed if the proof-printing is specified to the received printing job and if another printing job is being processed;

wherein the page printed for proofing is discharged to a discharge unit different from a discharge unit to which said another printing job is discharged.

4. An image forming device comprising:

a receiving unit which receives a printing job;

a control unit that performs control for intervening of a proof-printing to print at least one certain page of the received printing job in order to check its quality while an another printing job is being processed if the proof-printing is specified to the received printing job and if another printing job is being processed; and a receiving unit that receives an instruction concerning the printing job for which proof-printing is conducted after executing said proof-printing.

5. The image forming device as claimed in claim 4, wherein said instruction concerning the printing job includes instructions for deleting said printing job, temporarily halting at the start of said printing job, secondary proof-printing, and continuation of said printing job.

6. An image forming method, comprising:

receiving a printing job; and executing an intervening of a proof-printing to print at least one certain page of the received printing job in order to check its quality while an another printing job is being processed if the proof-printing is specified to the received printing job and if another printing job is being processed;

wherein the printed page for proofing contains information concerning the printing job including said page.

7. A computer readable storage medium stored with an image forming program for controlling an image forming device, wherein said image forming program causes said image forming device to execute a process comprising:

1) receiving a printing job; and 2) controlling the device to execute an intervening of a proof-printing to print at least one certain page of the received printing job in order to check its quality while an another printing job is being processed if the proof-printing is specified to the received printing job and if the another printing job is being processed;

wherein the printed page for proofing contains information concerning the printing job including said page.

* * * * *

UNITED STATES PATENT AND TRADEMARK OFFICE

CERTIFICATE OF CORRECTION

PATENT NO. : 7,616,906 B2
APPLICATION NO. : 11/497359
DATED : November 10, 2009
INVENTOR(S) : Kazuto Yamamoto It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 433 days.

Signed and Sealed this

Nineteenth Day of October, 2010

David J. Kappos

David J. Kappos
*Director of the United States Patent and Trademark Office*